United States Patent [19]

Ando

[11] 4,173,054

[45] Nov. 6, 1979

[54] FLOOR SWEEPER

[75] Inventor: Masumi Ando, Kashiwa, Japan

[73] Assignee: Hukuba Kogyo Kabushiki Kaisha, Chiba, Japan

[21] Appl. No.: 873,058

[22] Filed: Jan. 27, 1978

[30] Foreign Application Priority Data

Aug. 11, 1977 [JP] Japan ..... 52/96293
Aug. 11, 1977 [JP] Japan ..... 52/107377[U]

[51] Int. Cl.[2] ..... A47L 11/282

[52] U.S. Cl. ..... 15/98; 222/377; 401/284

[58] Field of Search ..... 15/50 C, 98, 320, 321; 401/281, 284; 222/377

[56] References Cited

U.S. PATENT DOCUMENTS

| | | | |
|---|---|---|---|
| 1,175,723 | 3/1916 | Dohn et al. | 15/50 C X |
| 1,536,687 | 5/1925 | Oatey | 15/50 C |
| 2,976,112 | 3/1961 | Yonkers et al. | 15/50 C X |
| 3,127,628 | 4/1964 | Klumb | 15/50 C |
| 3,346,896 | 10/1967 | Arones | 15/50 C |
| 3,789,449 | 2/1974 | MacFarland et al. | 15/98 |

FOREIGN PATENT DOCUMENTS

| | | | |
|---|---|---|---|
| 2451945 | 5/1975 | Fed. Rep. of Germany | 15/98 |

*Primary Examiner*—Edward L. Roberts
*Attorney, Agent, or Firm*—Wenderoth, Lind & Ponack

[57] ABSTRACT

A floor sweeper is disclosed. The floor sweeper has a handle, a main body including a detergent compartment, a roller mechanism including a roller with a washing belt thereon, a scraper and a waste fluid compartment. Detergent is dripped from the detergent compartment onto the washing belt. The washing belt washes a floor and wipes stains therefrom due to frictional contact therewith during the forward motion of the floor sweeper. Waste fluid soaked into the washing belt is squeezed from the belt by the scraper and is collected in the waste fluid compartment during the backward motion of the sweeper.

3 Claims, 8 Drawing Figures

FLOOR SWEEPER

BACKGROUND OF THE INVENTION

This invention relates to a floor sweeper and more particularly to a hand operated floor sweeper which can wipe stains from a floor and collect the waste fluid from the floor.

As a floor sweeper for the purpose of washing a floor surface by dripping a detergent onto a rotary brush, there are already known a floor sweeper wherein a rotary brush for washing a floor surface is pivotally mounted in a housing and wherein a detergent tank is disposed to supply the rotary brush with a detergent. However, this floor sweeper in the prior art has such drawbacks that although the floor surface is washed and cleaned in the washing operation, waste fluid cannot be collected therefrom and, subsequently, the fluid is left behind on the floor. If a carpet, particularly is taken as an example of a floor surface, waste fluid sinks deep into the carpet after the washing so that stains are formed at the back surface thereof, contrary to the cleanliness of the top surface.

Further, the known floor sweeper is provided with a valve means for supplying the rotary brush with detergent in a constant amount. However, it is difficult to keep the amount of the detergent supplied constant because the dripping amount thereof decreases as the detergent level is lowered. For this reason, the valve means must be adjusted often to keep the dripping amount constant in relation to the level of the detergent.

SUMMARY OF THE PRESENT INVENTION

Accordingly, it is an object of the present invention to provide a floor sweeper which can wash and clean a floor surface by wiping stains therefrom and collecting the resultant waste fluid.

It is anohter object of the present invention to provide a floor sweeper wherein handling the apparatus is very easy.

It is a further object of the present invention to provide a floor sweeper wherein the washing portion thereof may be easily replaced.

It is a still further object of the present invention to provide a floor sweeper wherein detergent is supplied in a constant amount onto a rotary brush regardless of any change in the level thereof in a detergent storage compartment.

According to the present invention, there is provided a floor sweeper which includes a handle for operating the floor sweeper by hand, and a main body having a detergent compartment for containing detergent for washing and cleaning a floor. A roller is provided for washing and cleaning the floor by wiping up the stains therefrom and for collecting the waste fluid from the floor surface. The roller has a washing belt on the outer surface of a roller and is adapted to be braked by a stopper which stops the rotation thereof during forward motion of the floor sweeper. The stopper can to be released to allow the rotation of the roller during the backward motion thereof. A scraper collects the waste fluid in the washing belt and is installed to slightly press the washing belt and squeeze the waste fluid therefrom. A waste fluid compartment contains the waste fluid collected by the scraper. A predetermined amount of the detergent is dripped onto the washing belt of the roller so that the floor is washed and cleaned by the detergent sunk in the washing belt and stains on the floor are wiped due to the frictional contact of the stopped roller portion during the forward motion of the floor sweeper, and the waste fluid is collected into the waste fluid compartment by the scraper from the washing belt of the rotating roller during the backward motion of the floor sweeper.

In a preferred embodiment of the present invention, the floor sweeper may be provided with a special compartment for adjusting the dripping rate of the detergent, the compartment having a ridge with an inside wall perpendicular to the moving direction of the floor sweeper and an outside wall planted toward the perpendicular wall.

The detergent compartment is provided with a plurality of projecting apertures through which the detergent is dripped directly onto the washing belt of the roller. Further, a valve mechanism may be installed in the dripping amount adjusting compartment so that the detergent is dripped through the valve means onto the washing belt.

BRIEF DESCRIPTION OF THE DRAWINGS

Other and further objects, features and advantages of the present invention will be apparent from the following description taken in connection with the accompanying drawings wherein.

DETAILED DESCRIPTION OF THE PREFERRED EMBODIMENTS

Figure 1:
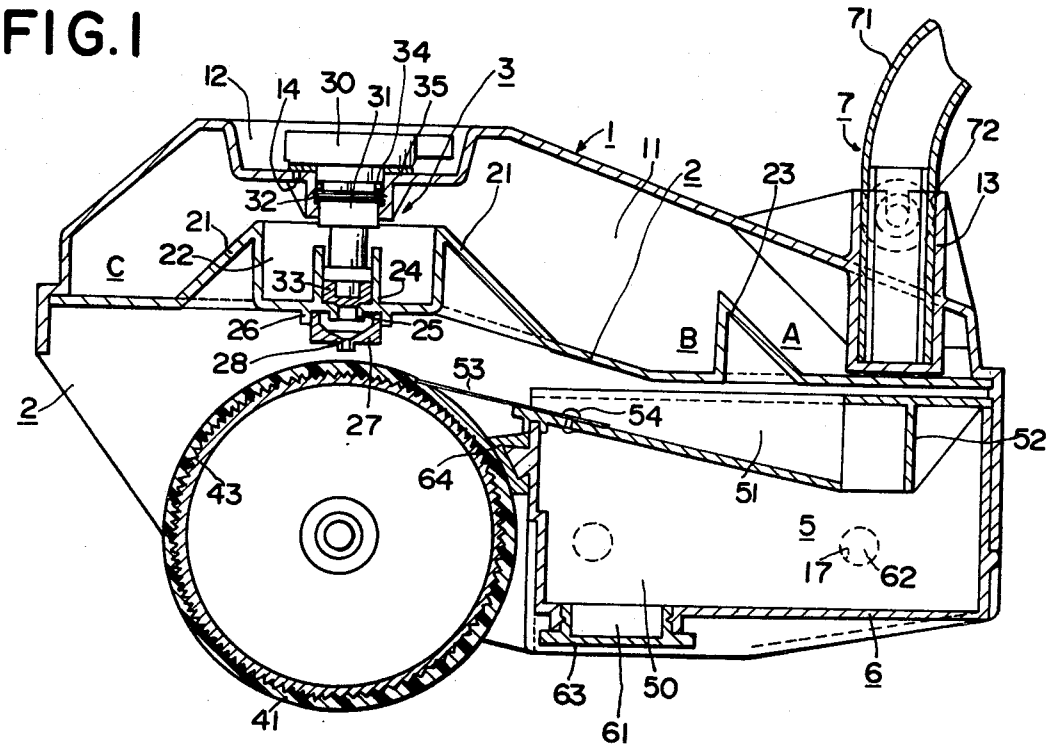
FIG. 1 is a sectional view illustrating one embodiment of a floor sweeper according to the present invention.
Figure 2:
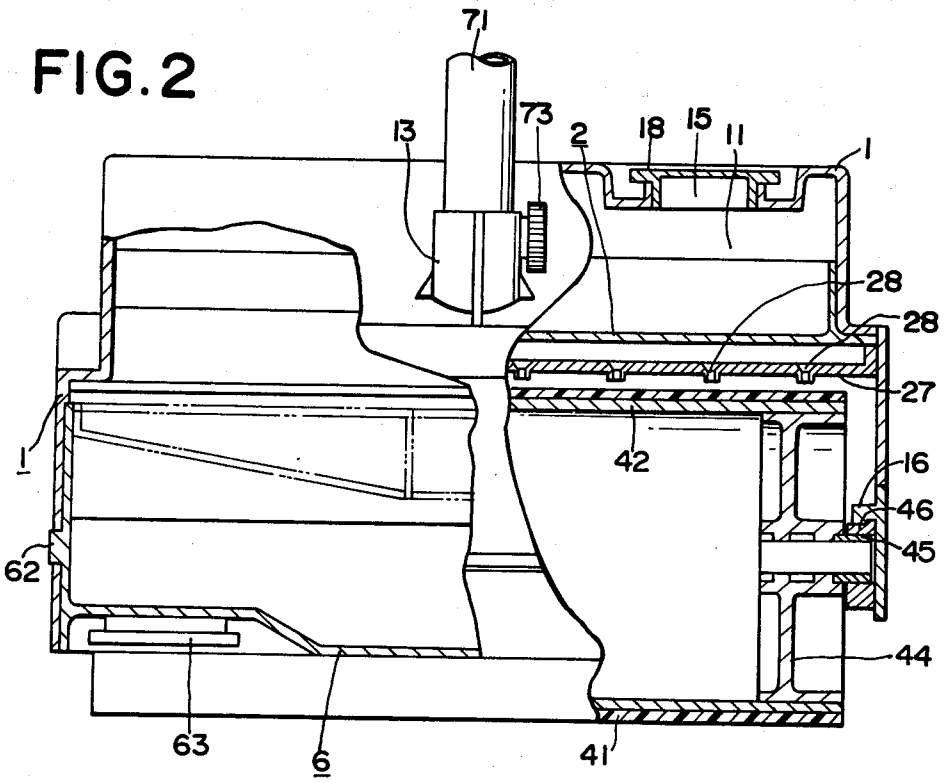
FIG. 2 is a back view including a partially sectional view illustrating one embodiment of a floor sweeper according to the present invention.

Referring to FIGS. 1 through 5, these views illustrate one embodiment of a floor sweeper for for washing a floor surface. A main body 1 of the floor sweeper is provided with a detergent compartment 11 with a bottom member 2 and side walls formed by the main body 1. Detergent contained in the detergent compartment 11 is dripped in predetermined amounts, which are adjusted by a valve mechanism 3, through projecting apertures onto a washing member 41 of a roller mechanism 4. The roller mechanism 4 is adapted to stop rotating when the floor sweeper moves forward; the roller mechanism 4, however rotates due to contact between the washing belt 41 and the floor as the floor sweeper moves backward. The floor is washed and cleaned by wiping up the stains thereon due to the frictional contact between the stopped washing belt 41, which holds the detergent therein, and the floor surface during the forward motion of the floor sweeper. After the washing operation, waste fluid absorbed by the washing belt 41 is squeezed from the belt 41 and collected in a waste fluid compartment 50 by a scraper 53 during the backward motion of the sweeper. This is a fundamental construction and operation of a floor sweeper according to the present invention. Further, the construction thereof will be explained in more detail as follows.

(1) Mechanism for the supplying of a detergent and the amount adjustment thereof Detergent or water is poured through a pouring mouth 15 into the detergent compartment 11. The detergent drips through a valve mechanism 3 which adjusts the amount thereof dripped onto the washing belt 41. The valve mechanism 3 comprises a valve seat 25 on the bottom member 2 and a rubber valve 33 fixedly covering the lower end of a shaft 31. The shaft 31 is provided with a knob 30 at the top thereof and has a ring shaped convex portion 32 threaded with a female screw formed at a downwardly extending portion of an opening 12. Turning of the knob 30 causes the shaft 31 and, accordingly, the rubber valve 33 to move vertically and thereby adjust the dripping rate of the detergent in accordance with the change in the gap between the valve seat 25 and the rubber valve 33. At the lower portion of the valve seat 25 is fixedly supported a block 27 with a plurality of projecting apertures 28 therethrough.

(2) Mechanism of a washing belt and a roller

A roller 42 is covered around its outer surface with the washing belt 41 which is barrel shaped both ends of the belt being open. The belt is cloth or nonwoven fabric. Detergent is continuously dripped through the projecting apertures 28 onto the washing belt 41. The roller 42 is formed at its outer surface with a plurality of striped convex ridges 43 which are parallel to the axis of the roller so that the washing belt 41 is prevented from sliding on the roller 42. A stopper member 64 is installed so that the roller mechanism 4 stops rotating when the floor sweeper moves forward, yet permits the roller mechanism 4 to rotate when the sweeper moves backward. The detergent is uniformly dripped onto the entire surface of the washing belt 41, so that the floor is washed and cleaned and due to the friction of the stopped washing belt 41 during the forward motion of the floor sweeper.

At the inner ends of the roller 42 are two members 44 for supporting a shaft 45 which is rotatably supported and fixed at both ends thereof through bearing members 46 to the main body 1.

(3) Mechanism for supporting a roller

Figure 4A:
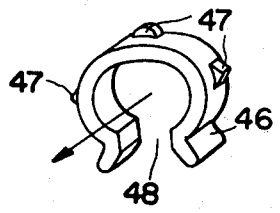
FIGS. 4 (A) and (B) are explanatory views illustrating a bearing member and convex portions for receiving the bearing member used in a floor sweeper according to the present invention.
Figure 4B:
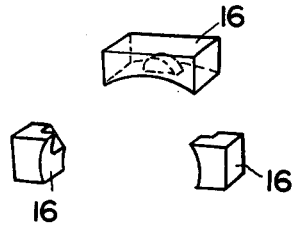

The inner surfaces of the side walls of the main body 1 have protrusions 16 thereon for receiving the elastic bearing members 46. The protrusions 16 are adapted to press the bearing member 46 inwardly as shown in FIG. 4A so that the bearing member 46 is held in such a manner that the concavities of the protrusions 16 engage with the convexities of the bearing member 46 respectively as shown in FIG. 4B so that the bearing member will not drop down when the bearing member 46 is inserted in its compressed shape into the protrusions 16. Once in place, the bearing member 46 may no longer detached in the direction of an arrow in FIG. 4A from the protrusion 16. The shaft 45 is forcedly inserted through an opening 48 into the bearing member 46. The shaft 45 is firmly and rotatably supported by the bearing member 46 because the opening 48 thereof is narrowed due to the elasticity thereof. However, the shaft can be removed by forcefully widening the opening 48 thereof so as to allow passage therethrough of the shaft.

(4) Mechanism for rotating and stopping a roller

The bearing member 46 is eliptical so as to allow a shaft 45 to move forward and backward therein. This causes the roller mechanism 4, that is, the shaft 45 thereof, to move backward as shown by the letter Y in FIG. 3 when a frictional resistance is established between the washing belt 41 and the floor surface during the forward motion of a floor sweeper. Accordingly, the rotating of the roller mechanism 4 can be forcefully stopped because the washing belt 41 presses against a stopper 64. The stopper 64 has an uneven surface and is installed on the inner side wall of the box member 6 of the waste fluid compartment. The roller 43 can be braked by the stopper 64 even when the washing belt 41 is decreased in its diameter due to the abrasion thereof because the shaft 45 of the roller 43 is positioned in the bearing member 46 so that it has a clearance therein in which it is able to move toward the stopper 64 as shown by a letter X in FIG. 3.

Figure 3:
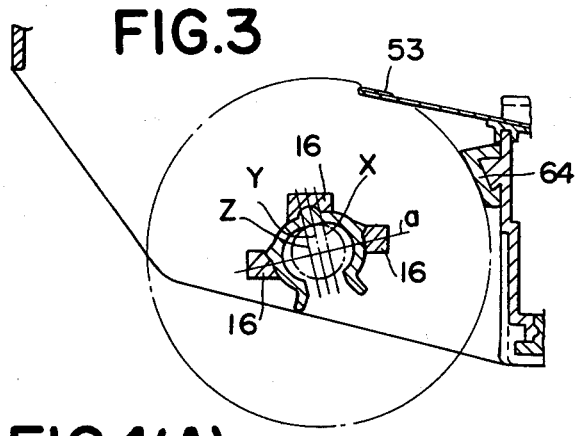
FIG. 3 is a partial sectional view illustrating a bearing mechanism for a roller and a stopper mechanism used in a floor sweeper according to the present invention.

On the other hand, the shaft 45 is forced forward as shown by a letter Z in FIG. 3 during the backward motion of the floor sweeper so that the roller mechanism 4 is allowed to freely rotate with the washing belt 41, since it is released from contact the stopper 64. It is preferred that the eliptical bearing member 46 be supported with the slanting center line thereof ascended at the right end thereof, as shown by letter a in FIG. 3. In this embodiment, the slant is 15°. However, it should be understood that there is no limitation on that degree.

(5) Mechanism for collecting waste fluid

A floor is washed and cleaned are due to contact therewith by the washing belt 41 which holds detergent dripped from a detergent compartment 11. Waste fluid, including removed stains soaked into the washing belt 41, is squeezed from the belt by the scraper 53 as the washing belt 41 rotates in the clockwise direction during the backward motion of the floor sweeper. In more detail, the waste fluid falls into the waste fluid compartment 50 through an entrance 51 in the upper member 5 thereof. The waste fluid is discharged through a discharging mouth 61 after a sufficient amount is collected. At the back side of the entrance 51 is a reverse flow preventing plate 52 under the upper member 5 for preventing the waste fluid from flowing in the reverse direction. The scraper 53 is plate shaped and is affixed to the upper member 5 by a rivet 54. The scraper 53 may be metal or plastic and may be constituted such that the waste fluid can be squeezed from the washing belt 41 by using an elastic scraper pressing downwardly it. Further, the scraper may be formed integrally with the upper member 5.

(6) Mechanism for maintaining the detergent level

Within the bottom member 2 are two wave-shaped convex member 21 and 23. An adjusting groove 22 consists of this pair of wave-shaped convex portions and the side walls of the bottom member 2 to thereby provide a predetermined level of detergent for the valve mechanism which continuously drips detergent at a constant rate even though the amount of detergent continuously diminishes. When the floor sweeper according to the present invention moves forward and backward by the operation of a handle installed thereto, the detergent there inside shakes in accordance with this forward and backward motion. It is assumed that the level of the detergent gradually becomes lower than the height of the wave shaped convex portions 21 as the detergent is dispensed. However, when this is the case, the detergent positioned in an area A is forced to move into an area B and then into the adjusting groove 22 over the wave shaped convex portions 21 and 23 in accordance with the shaking motion of the floor sweeper, as shown in FIG. 1. The detergent positioned in an area C also moves into the adjusting groove 22. In this manner, the adjusting groove 22 is always filled with detergent regardless of the overall supply of detergent in the sweeper. In the valve guide 24 in the center of the adjusting groove 22 are a plurality of vertical slits reaching the bottom thereof to allow the detergent to be dripped. The dripping rate is always constant because the valve mechanism assumes a single position and the adjusting groove 22 is always filled with the detergent as mentioned above. The wave shaped convex portions have a vertical wall and a slanting wall which help to move the detergent into the adjusting groove in accordance with the shaking motion of the sweeper.

(7) Assembly and operation of a floor sweeper according to the present invention The floor sweeper according to the present invention is constructed as follows. The bottom member 2 is welded to the main body 1 by using, for example, a high frequency means etc; the shaft 31 covered with the rubber valve 34 and having a rubber packing 35 and an O ring 34 thereon is inserted through an opening 12 on the upper portion of the main body 1; and is turned a knob to thread the shaped convex portion of the shaft 31 with a female screw onto a downwardly extending portion of the opening 12. The rubber packing 35 is closely in contact with an air aperture 14 in the opening 12 to prevent air from flowing and thereby stopping the dripping of the detergent as the knob is turned to close the valve while the flow of air through the air aperture helps the detergent to drip as the knob is turned upward along with the rubber packing to open the valve. The O-ring only works to keep a water tight characteristic.

The block 27 is inserted into the block support 26 underneath member 2. The scraper 53 is fixed to the upper member 5 by a rivet 54 and the upper member 5 is welded to the box member 6 of the waste fluid compartment by using a high frequency means etc.

The bearing members 46 engage the protrusions 16 which are designed to receive the bearing members, the convex portions thereof are positioned on inside walls of the main body 1. Further, fixing apertures 17 and protrusions and 62 are connected to each other to provide for the assembly of the main body 1 and the waste fluid compartment 50.

A handle portion 72 is inserted into to a handle support 13. A reinforced member 72 is inserted into the lower inside of the handle 71 to provide a reinforced handle and to ensure a secure connection between the handle portion and the support 13. The handle may be a single rod or may be several rod units which can be connected to each other. A detergent pouring opening 15 and the discharging opening 61 are covered with caps 18 and 63 respectively.

Figure 6:
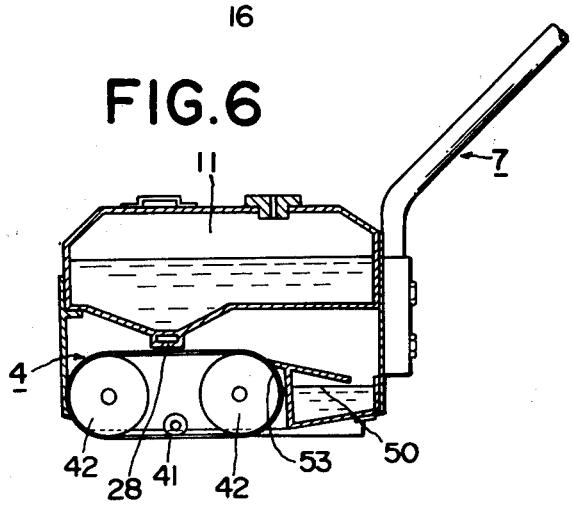
FIG. 6 is a sectional view illustrating a second embodiment of a floor sweeper according to the present invention.
Figure 5:
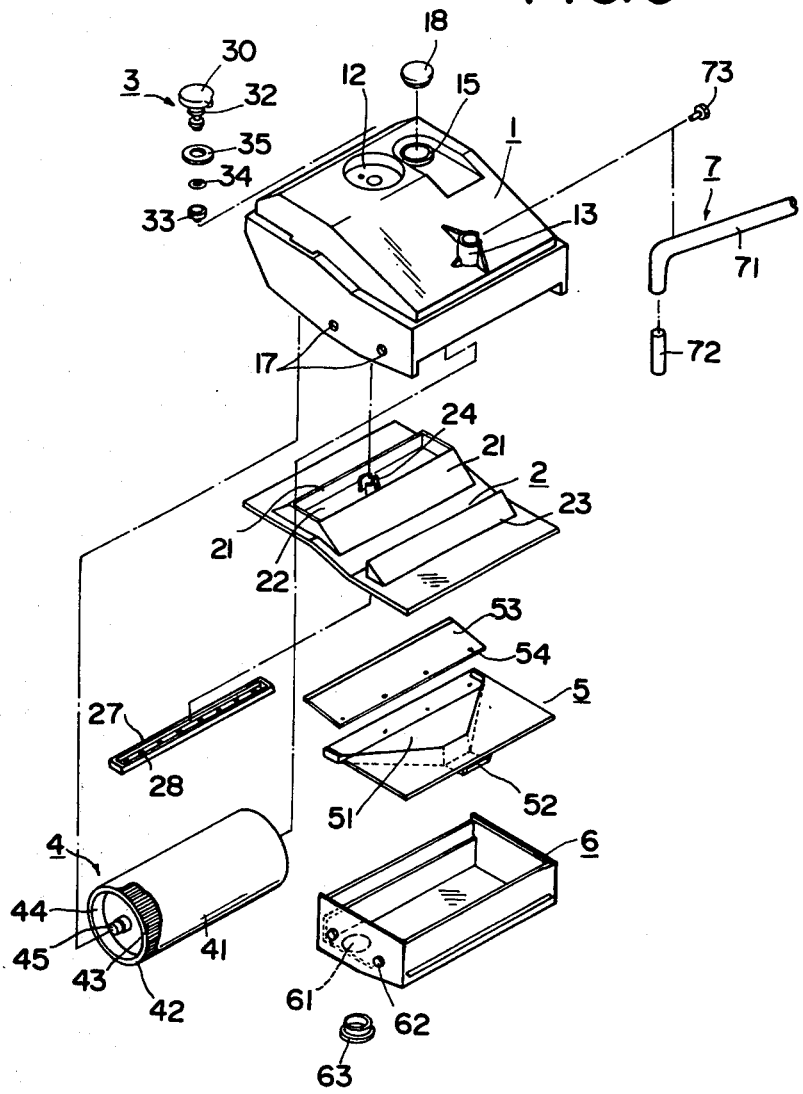
FIG. 5 is an exploded view illustrating a floor sweeper according to the present invention.

Referring next to FIG. 6, there is shown another embodiment of a floor sweeper according to the present invention. This floor sweeper comprises a roller mechanism 4, a handle 7 and a detergent compartment 11. The roller mechanism 4 comprises a pair of rollers 42 and an endless washing belt 41 stretched around the rollers 42. At the bottom of the detergent compartment 11 are a plurality of projecting apertures 28. A scraper 53 is positioned to press slightly against the washing belt 41 so that the waste fluid is collected in a waste fluid compartment 50.

Figure 7:
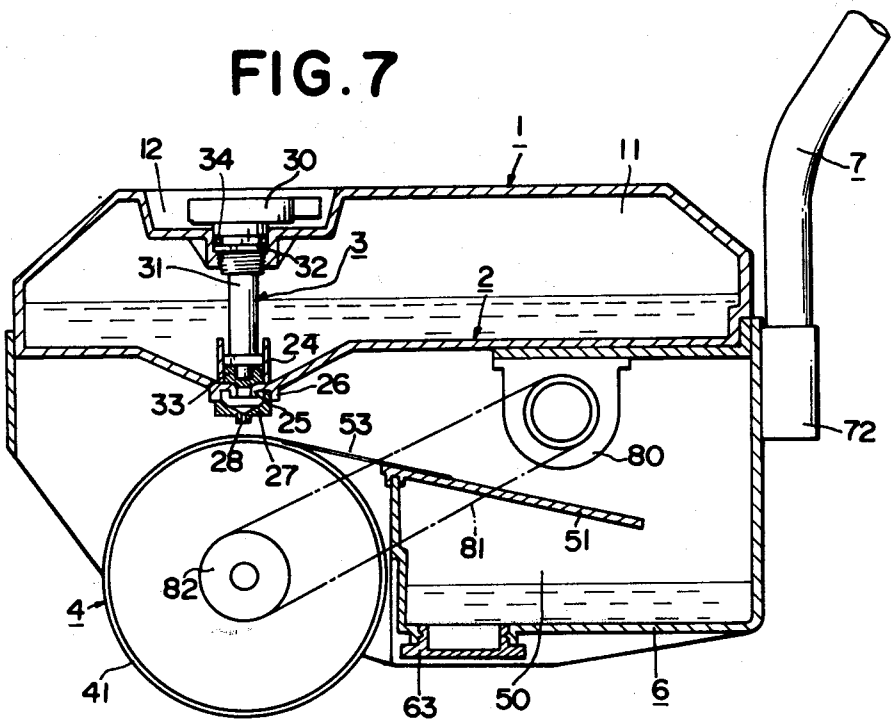
FIG. 7 is a sectional view illustrating a third embodiment of a floor sweeper in a further embodiment according to the present invention.

Referring final to FIG. 7, there is shown a further embodiment of a floor sweeper according to the present invention. In this embodiment, like numerals refer to like parts in FIGS. 1 through 6 so that respective explanations thereof are not made. However, an important difference in this embodiment is that the roller mechanism 4 is driven by a motor 80 installed underneath the bottom member 2. A belt 81 is suspended between the motor 80 and a shaft 82 of the roller 4. The motor 80 may be turned on intermittently so as to stop its rotation during the forward motion of a floor sweeper. Alternatively, the motor 80 may be turned on continuously in the clockwise direction so that a friction of a washing belt with a floor is doubled to provide a better wiping operation of the floor during the forward motion of a floor sweeper while the floor sweeper is easy to move in the backward direction during the backward motion thereof.

The following effects are expected in accordance with the construction of a floor sweeper of the present invention.

(a) It is possible to wash and clean a floor by wiping up stains therefrom and to collect the waste fluid simultaneously in accordance with a series of the forward and backward motions performed by an operator. In one experiment, 75% of the detergent supplied from the detergent compartment was collected in the waste fluid compartment.

(b) The amount of a detergent dripped is easily adjusted by only turning a knob in a valve mechanism.

(c) It is easy to replace the washing belt and a roller with new ones when they become dirty.

(d) The apparatus cleans very well because the application of the detergent and the washing are performed when the washing belt is stopped.

(e) The means for collecting the waste fluid is simple.

(f) The amount of a detergent being dripped is always constant regardless of the decrease in volume of detergent because of the provision of the groove for adjusting the dripping amount, which includes the wave shaped convex portions on the bottom of a detergent compartment.

(g) A floor sweeper according to the present invention is constructed of numerous parts, each of which is easy and simple in construction, thereby making assembly, disassembly and transportation very easy.

What I claim is:

1. A floor sweeper comprising:

a sweeper body;

a handle connected to said sweeper body for moving said sweeper body;

roller means within said sweeper body for washing and wiping a floor, said roller means comprised of a roller rotatably mounted in said body and a washer belt on the outside of said roller;

a liquid compartment within said sweeper body above said roller means, said liquid compartment being adapted to hold liquid therein and supply said liquid to said washer belt therebeneath;

stopper means within said sweeper body adjacent said roller means for preventing said roller means from rotating when said sweeper body is moved forward and for allowing said roller means to rotate when said said sweeper body is moved rearward;

scraper means contacting said washer belt for squeezing liquid from said washer belt when said roller means is rotated; and waste fluid container means adjacent said scraper means for collecting fluid squeezed from said washer belt by said scraper means.

2. A sweeper as claimed in claim 1, further comprising valve means in said liquid compartment for allowing a predetermined amount of liquid in said compartment to flow from said compartment toward said roller means.

3. A sweeper as claimed in claim 1, further comprising:

a plurality of elliptical bearing member means within said sweeper body for rotatably mounting said roller means therein, one bearing member means being at each end of said roller means, and each of said bearing member means having an opening at its lower side for receiving said roller means therein.

* * * * *